US007126097B2

(12) United States Patent
Kim et al.

(10) Patent No.: US 7,126,097 B2
(45) Date of Patent: Oct. 24, 2006

(54) ELECTRIC OVEN AND CHOKING STRUCTURE FOR THE SAME

(75) Inventors: Yang Kyeong Kim, Bucheon-si (KR); Wan Soo Kim, Gwangmyeong-si (KR); Jong Sik Kim, Seoul (KR); Young Min Lee, Incheon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/833,042

(22) Filed: Apr. 28, 2004

(65) Prior Publication Data

US 2005/0045627 A1 Mar. 3, 2005

(30) Foreign Application Priority Data

Aug. 25, 2003 (KR) ..... 10-2003-0058656

(51) Int. Cl.
*H05B 6/76* (2006.01)
*F24C 7/02* (2006.01)

(52) U.S. Cl. ..... 219/741; 219/740; 174/35 GC

(58) Field of Classification Search ..... 219/739–743, 219/681, 685; 174/35 R–35 GC, 35 MS
See application file for complete search history.

(56) References Cited

U.S. PATENT DOCUMENTS 3,846,608 A * 11/1974 Valles ..... 219/741
4,059,742 A * 11/1977 Baron ..... 219/741
4,081,647 A * 3/1978 Torrey ..... 219/741
5,036,171 A * 7/1991 Kim et al. ..... 219/742
2004/0079751 A1 4/2004 Kim et al.

FOREIGN PATENT DOCUMENTS

GB 2 002 210 * 2/1979
JP 54-26549 * 2/1979 ..... 219/741

* cited by examiner

*Primary Examiner*—Philip H. Leung
(74) *Attorney, Agent, or Firm*—Greenblum & Bernstein, P.L.C.

(57) ABSTRACT

Disclosed is an electric oven including an outer case, a cavity formed in the outer case to receive food, an operating part formed on the outer case to operate the oven, a heater formed to transmit heat into the cavity, a magnetron for oscillating microwave to heat food loaded in the cavity, a door formed on a front of the outer case to selectively open the cavity, a choking portion disposed on an inner surface of the door to shield microwave; and a step formed on a portion, which contacts the choking portion, of the inner surface of the door.

18 Claims, 6 Drawing Sheets

ELECTRIC OVEN AND CHOKING STRUCTURE FOR THE SAME

BACKGROUND OF THE INVENTION

1. Field of the Invention

The present invention relates to an electric oven, and more particularly, to a choking structure for preventing microwave from being leaked through a gap between a door and a case of an electric oven. Especially, the present invention is directed to an improved choking structure of an electric oven, which allows microwave leaked through a gap between a door and a case of the electric oven to be shielded simply with reliability. The choking structure of the present invention can also be applied to any devices having a magnetron for oscillating microwave, not being limited to the electric oven.

2. Description of the Related Art

Generally, a conventional electric oven is a kind of cooking device having a heater for generating heat and a magnetron for generating microwave to heat food. The heat generated by the heater and the microwave generated by the magnetron are transmitted to the food loaded in a cavity of the oven.

The heat generated by the heater functions as a main heat source for cooking while the microwave generated by the magnetron functions as a sub-heat source for the cooking.

The conventional electric oven further includes a case defining the cavity and a door mounted on a front of the case to allow for the load and unload of the food in and from the cavity.

Meanwhile, since the microwave generated from the magnetron is a big health hazard, it is general to provide a microwave shielding structure for preventing the microwave from leaking out of the cavity. However, since the door is mounted on the front of the case while back, left and right sides, and top and bottom of the oven are shielded by the case, it is difficult to perfectly prevent the leakage of the microwave.

That is, the door is designed to be opened for loading and unloading the food and to be closed during the cooking. Therefore, as a microwave shielding structure, a choking portion is formed on a portion where the door contacts the case to prevent the microwave from leaking.

FIG. 1 shows a sectional view of a conventional electric oven, illustrating a portion where a door contacts a case.

Referring to FIG. 1, a conventional electric oven includes a cavity 2 in which food is loaded, a door 1 for selectively enclosing the cavity 2, and a choking portion 3 formed on a portion where the door 1 contacts the cavity 2. The choking portion 3 is extended toward opposite sides on an inner surface of the door 1. The extended portion is bent and extended in another direction such that the microwave discharged in the cavity 2 is shielded by the choking portion 3. Also, the choking portion 3 has a predetermined vertical length A1 and a horizontal length B1. The vertical length A1 and the horizontal length B1 allow a substantial overall extended length (L11+L12) acting as a factor for attenuating microwaves to be determined by a choking camber 35 that is a space between the door 1 and the choking potion 3 and to be once bent.

The function of the choking portion is determined by the substantial entire extended length (L11+L12). That is, the longer the substantial entire extended length (L11+L12), the better the microwave attenuation effect.

Therefore, in order to increase the substantial entire extended length (L11+L12), the vertical and horizontal lengths of the choking portion 3 should be maintained to be greater than predetermined lengths. Therefore, it may be considered that the vertical length A1 is increased while a vertical width of the door 1 is reduced. In this case, since the overall shape of the door 1 is varied, the microwave attenuation effect of the choking portion is also varied. Particularly, the microwave attenuation effect with respect to a specific frequency oscillated in the magnetron is weakened or deteriorated.

In addition, it can be also considered that the horizontal length B1 is increased while a thickness of the door 1 is increased. However, when the thickness of the door 1 is increased, there may be following problems.

First, the increased thickness of the door 1 increases the weight of the door, making it difficult for a user to open and close the door.

Second, the usable space of the cavity 2 is reduced by an increased thickness T1 of the door 1, the food receiving space is reduced.

Third, the increased thickness of the door 1 makes it difficult to define an exterior of the oven while increasing the manufacturing costs.

SUMMARY OF THE INVENTION

Accordingly, the present invention is directed to a choking structure of an electric oven that substantially obviates one or more problems due to limitations and disadvantages of the related art.

An object of the present invention is to provide an electric oven having a choking structure that can improve a microwave attenuation effect while reducing a thickness of the door and increasing a food receiving space.

Another object of the present invention is to provide a choking structure that is designed to be proper for a specific frequency bandwidth of a magnetron.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an electric oven comprising: an outer case; a cavity formed in the outer case to receive food; an operating part formed on the outer case to operate the oven; a heater formed to transmit heat into the cavity; a magnetron for oscillating microwave to heat food loaded in the cavity; a door formed on a front of the outer case to selectively open the cavity; a choking portion disposed on an inner surface of the door to shield microwave; and a step formed on a portion, which contacts the choking portion, of the inner surface of the door.

In an aspect of the present invention, there is provided a choking structure of an electric oven, comprising a cavity for receiving food; a magnetron for oscillating microwave to heat food received in the cavity; a door mounted on a front of the cavity and provided at an inner surface with a step; and a choking portion fixed on the inner surface to define a choking chamber with the step to attenuate microwave.

In another aspect of the present invention, there is provided a choking structure of a cooking device, comprising a cavity for receiving food; a door mounted on an opening of the cavity and provided at an inner surface with a step; and a choking portion fixed on the inner surface to define a choking chamber with the step to attenuate microwave.

According to the present invention, the choking structure improves a microwave attenuation effect while reducing a thickness of the door and increasing a food receiving space.

In addition, as the entire extended length of the choking portion is increased, the attenuating bandwidth can be widened, while improving the microwave attenuation effect.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
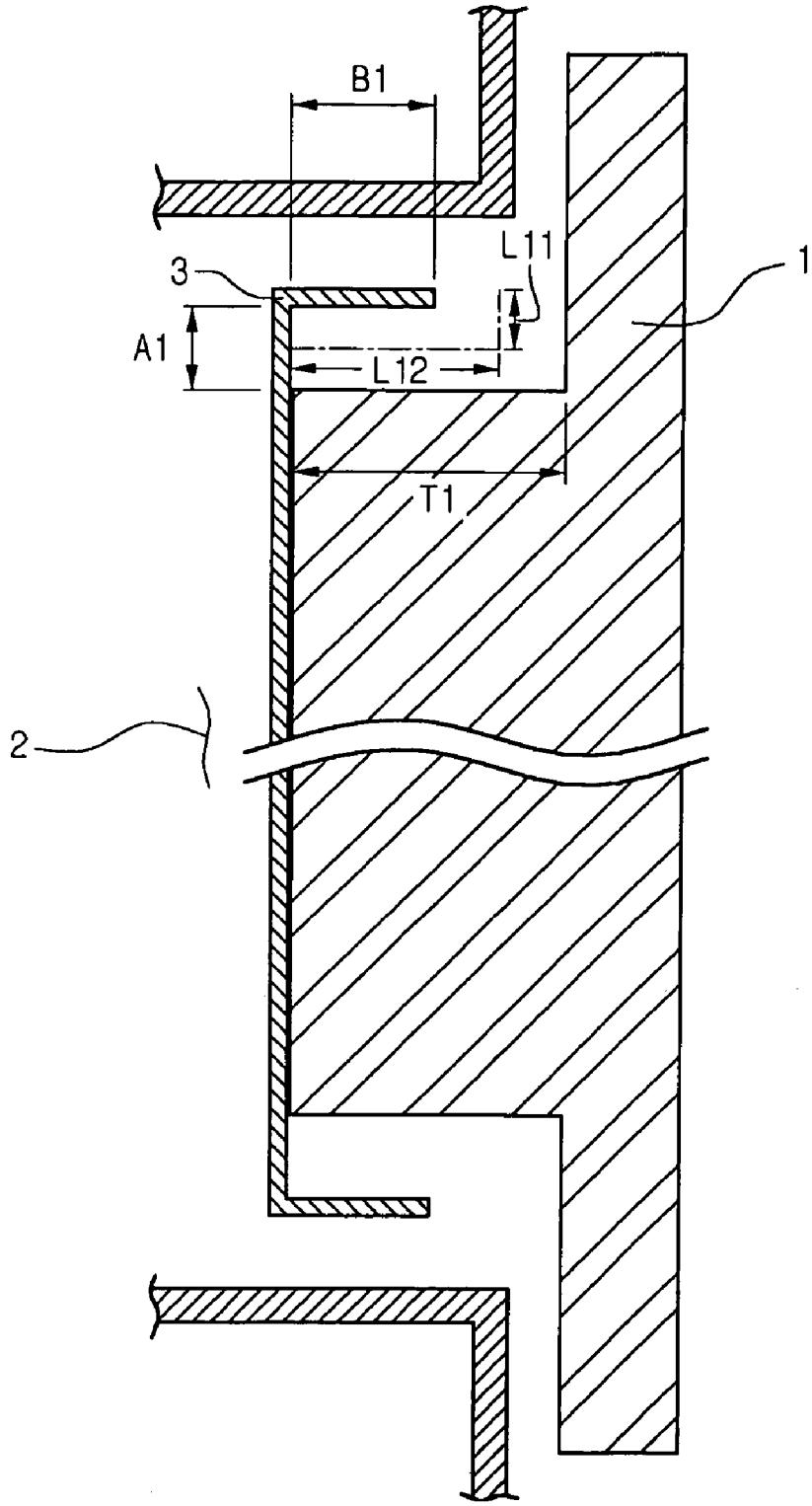
Fig. 1 related art
FIG. 1 is a sectional view of a conventional microwave oven, especially illustrating a portion where a door contacts a case.
Figure 2:
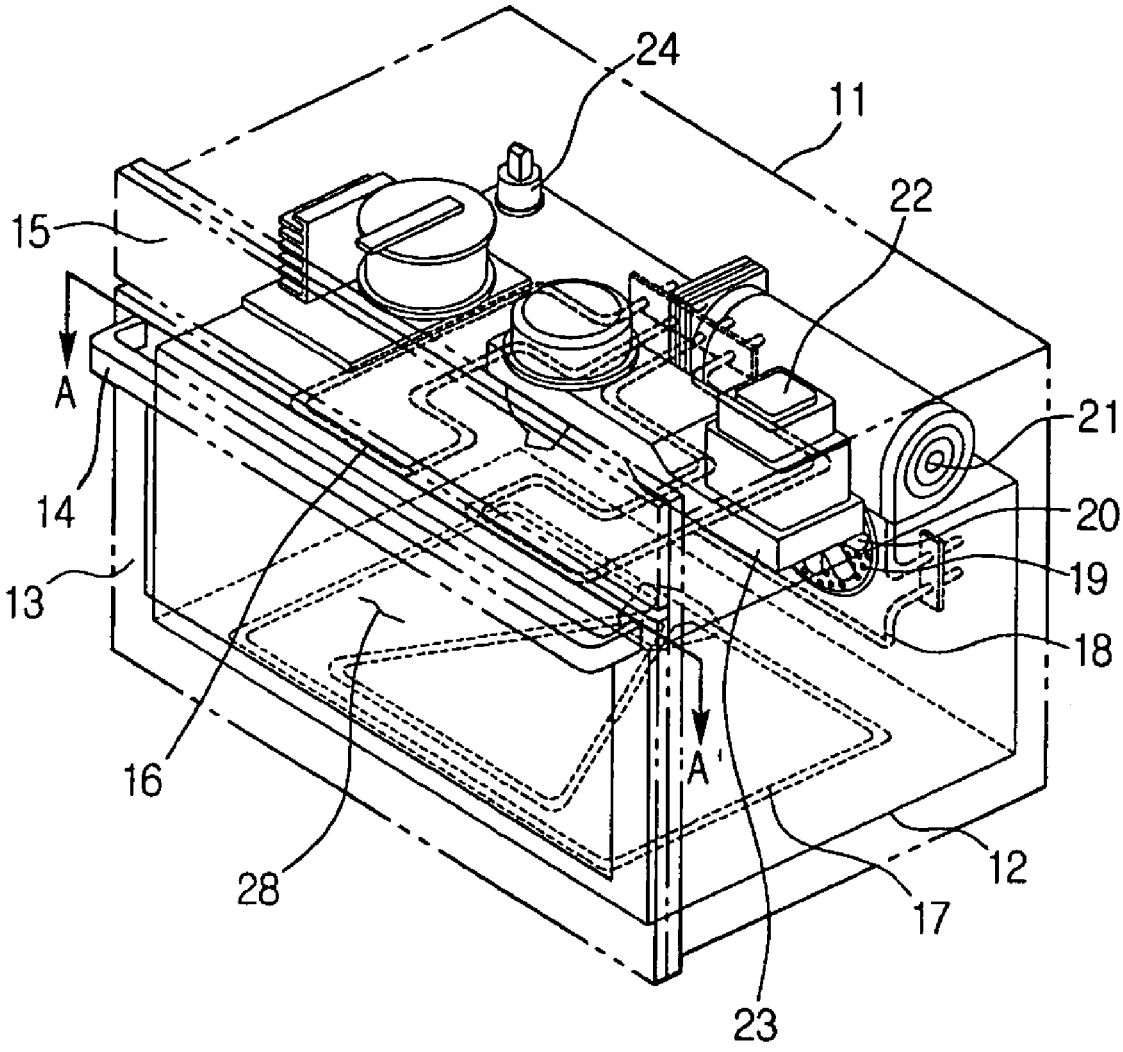
FIG. 2 is a perspective view of an electric oven according to a preferred embodiment of the present invention.

FIG. 2 shows a perspective view of an electric oven according to a preferred embodiment of the present invention.

As shown in the drawing, the inventive electric oven comprises an outer case 11, an inner case 12 disposed in the outer case to define a cavity 28 in which food is loaded, a door 13 pivotally mounted on a front of the outer case 11 to selectively open the cavity 28 and provided with a handle 14, and a display part 15 installed on a front-upper surface of the cavity 28 to display an operating state of the electric oven. The electric oven further comprises heating means for heating food loaded in the cavity 28. The heating means includes a lower heater 17 installed under the cavity 28 to transmit heat into the cavity 28 through a bottom of the cavity 28, an upper heater installed on a top of the cavity 28 to heat the food loaded in the cavity 28, a convection heater 18 formed between a back of the cavity 28 and the outer case 11, a convection fan 20 for directing air heated by the convection heater 18 into the cavity 28, and a magnetron 22 installed between the top of the inner case 12 and the outer case 11 to oscillate a microwave for heating the food loaded in the cavity. The electric oven further includes a cooling fan 21 disposed rearward the magnetron 22 to cool down electric components including the magnetron 22 and a lamp 24 for lighting up the inside of the cavity 28.

Formed on the back of the inner case 12 corresponding to the convection heater 18 are a plurality of apertures 19 through which the air heated by the convection heater 18 is directed into the cavity 28 as the convection fan 20 is operated. The magnetron 22 is associated with a waveguide disposed on the top of the inner case 12 to supply the microwave into the waveguide.

The operation of the above-described electric oven will be described hereinafter.

After the food is loaded in the cavity 28, the door 13 is closed and the cooking is processed. At this point, the heat discharged from the lower heater 17 installed under the cavity 28 is transmitted to the bottom of the cavity 28 and is then further transmitted to the food through the inner air of the cavity, a tray on which the food is disposed, and the like. In addition, the heat discharged from the upper heater 16 installed on the top of the cavity 28 is transmitted to the food by radiation and convection. In addition, the heat discharged from the convection heater 18 is transmitted in the formed of a hot wind through the apertures 19 formed on the back of the cavity 28 by the operation of the convection fan 20. Accordingly, the food loaded in the cavity 28 is cooked by the above-described three types of heating means.

Meanwhile, the microwave oscillated from the magnetron 22 is transmitted to the cavity 28 through the waveguide 23. The user can selectively use the microwave from the magnetron 22 for the cooking. However, as is well known, the microwave oscillated from the magnetron 22 is a big health hazard, it should not be transmitted to an external side. Therefore, in order to prevent the microwave from being discharged to the external side, a choking portion for attenuating the microwave is formed on a portion where the door 13 contacts the inner case 12 and/or a portion where the door 13 contacts the outer case 11.

The choking portion will be described more in detail hereinafter.

Figure 3:
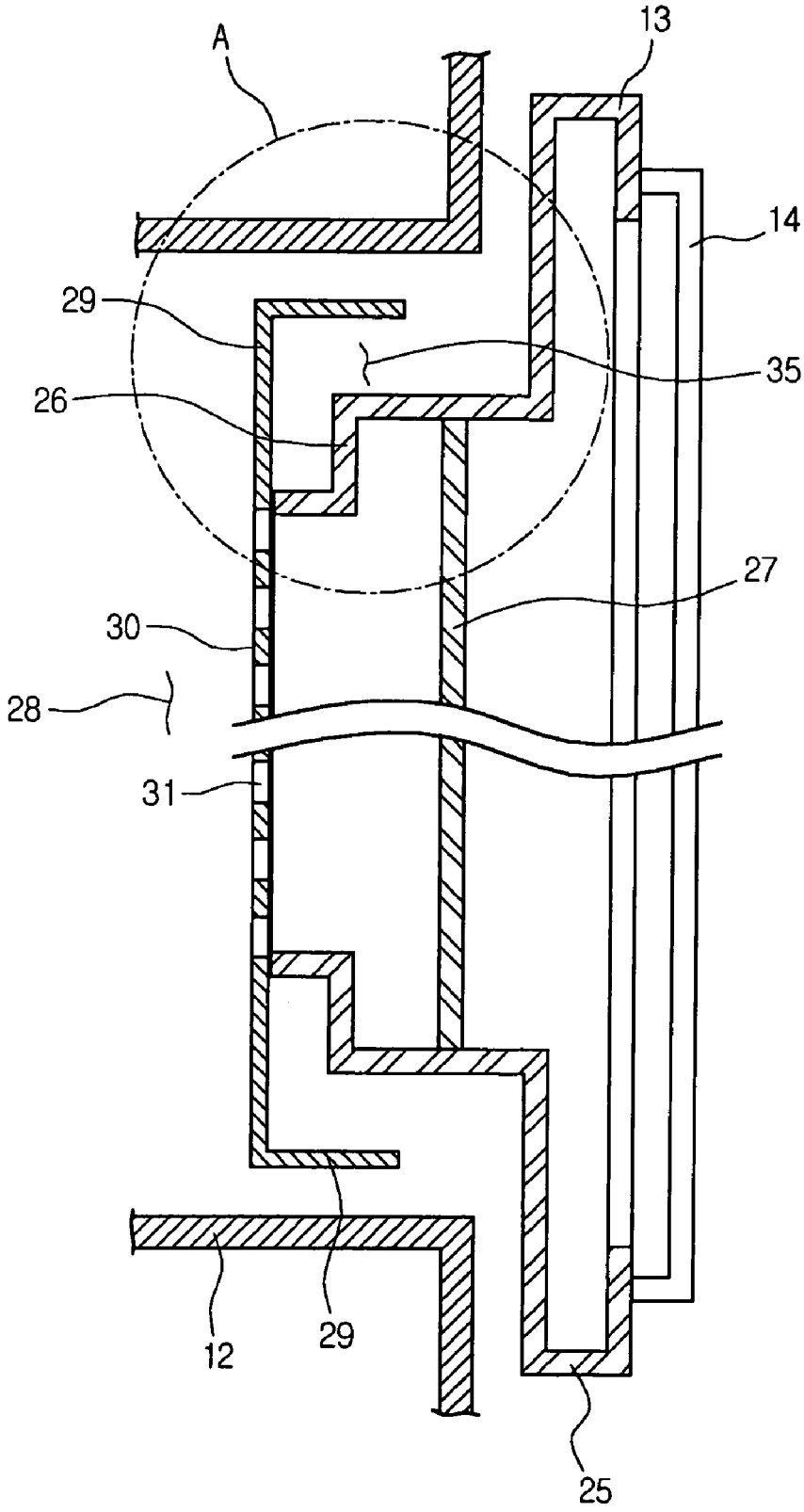
FIG. 3 is a sectional view taken along the line A–A' of FIG. 2.
Figure 4:
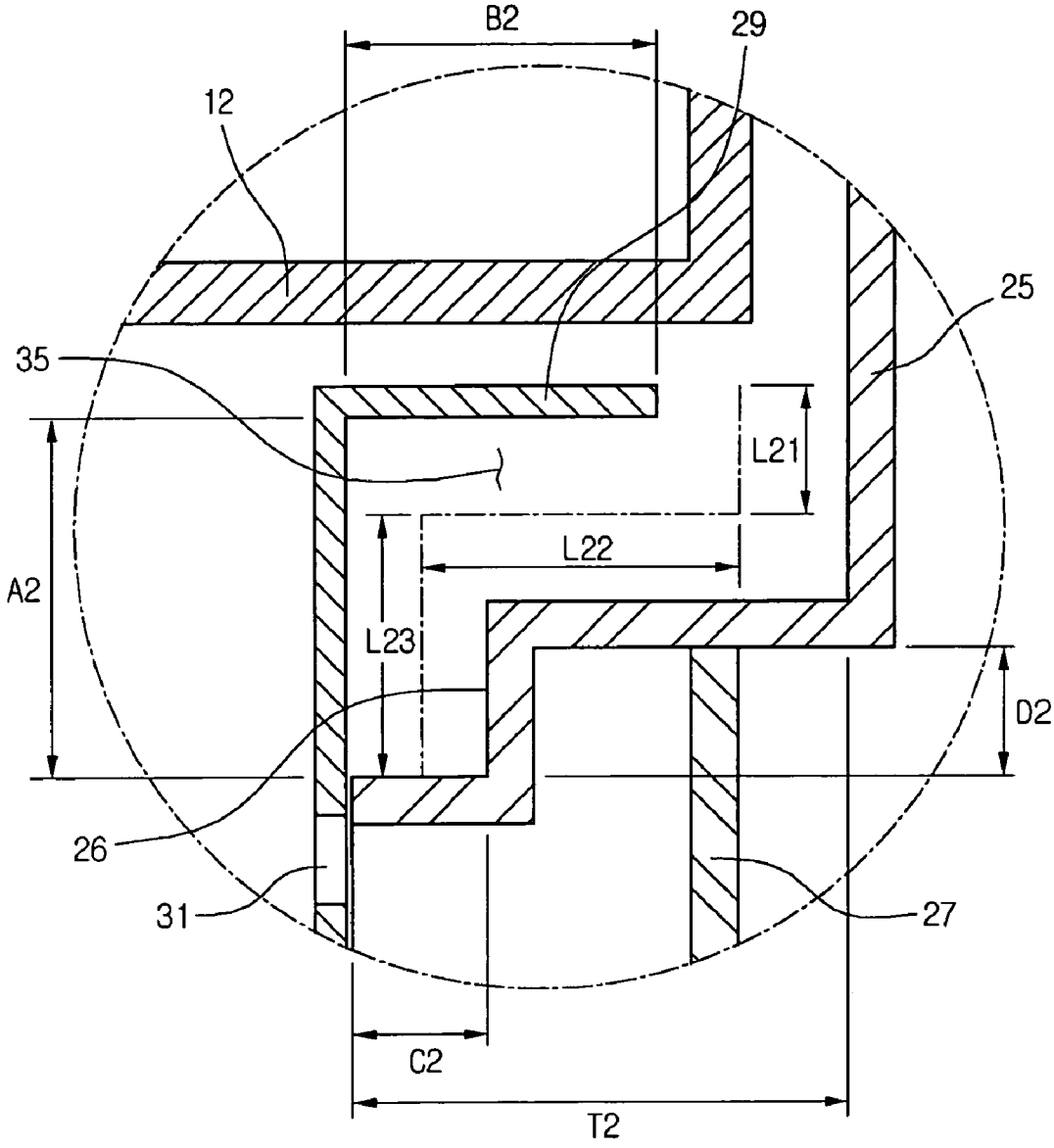
FIG. 4 is an enlarged view of a circled portion "A" of FIG. 3.

FIG. 3 is a sectional view taken along the line A–A' of FIG. 2, and FIG. 4 is an enlarged view of a circled portion A of FIG. 3.

Referring to FIG. 3, there are provided the above-described door 13, handle 14, cavity 28, and inner case 12.

In detail, there are further provided a doorframe 25 defining a main body of the door 13, a light-transmittable protecting panel 27 for allowing the user to observe the inside of the cavity 27 and a handle 14 for allowing the user to open and close the door. Particularly, an inner surface of the door 13 is provided with a step 26 so that a substantial entire extended length (L21+L22+L23) of the choking portion can be lengthened. By the lengthened choking portion, the microwave attenuation effect can be further improved.

That is, a protecting choking portion 29 comprises a vertical portion disposed to be vertical to an inner surface of the door 13 and a horizontal portion disposed to be parallel to the inner surface of the door 13, the horizontal portion extending from the vertical portion at right angles. A screen 30 for shielding the microwave discharged in the cavity 28 is integrally extending from the horizontal portion of the protecting choking portion 29. The screen 30 is provided with a plurality of apertures 31 through which the user can observe the inside of the cavity 28.

The operation of the choking portion will be described hereinafter.

The microwave discharged in the cavity 28 is attenuated and shielded by the choking portion 29. That is, the microwave cannot be discharged to the external side. Particularly, since the substantial entire extended length (L21+L22+L23) of the choking portion 29 is lengthened by the step 26, the attenuation effect of the microwave can be further improved. Furthermore, since the substantial shape of the door 13 is not changed, the attenuation effect with respect to a specific frequency of the magnetron 22 is not weakened or varied.

In addition, since the microwave in the cavity 28 is shielded by the screen 30, it cannot be externally leaked. The apertures 31 formed on the screen 30 allow the user to observe the cooking state in the inside of the cavity 28.

The choking portion will be described more in detail with reference to FIG. 4.

As described above, the substantial entire extended length (L21+L22+L23) of the choking portion 29 is lengthened by the step 26, the attenuation effect of the microwave can be further improved. That is, as the substantial entire extended length (L21+L22+L23) of the choking portion 29 is increased, a bandwidth is enlarged to improve the shielding effect of the microwave. Accordingly, the shielding effect can be further improved as compared with other electric oven having an identical volume. That is, a vertical length A2 of the choking portion 29 formed on an outer circumference of the inner surface of the doorframe 25 is further lengthened inward, and the doorframe 25 is bent near a portion where the doorframe 25 contacts the choking portion 29.

Describing in more detail, the step 26 is formed on a portion where the inner surface of the doorframe 25 contacts the choking portion 29. The step 26 has a vertical length D2 and a horizontal length C2, contacting the choking portion 29. The choking portion 29 is vertically bent having a vertical length A2 and a horizontal length B2. In this state, the substantial entire extended length (L21+L22+L23) of the choking portion may be further increased. When it is further increased, the microwave shielding effect can be further improved. Particularly, the vertical length A2 is increased by the vertical length D2.

According to the preferred embodiment of the present invention, since the substantial entire extended length (L21+L22+L23) of the choking portion as well as the vertical length A2 is increased as compared with the conventional electric oven while the horizontal length B2 is identical to or greater than that of the conventional electric oven, a thickness T2 of the door 13 that is inserted in the cavity 28 can be identical to or less than that of the conventional electric oven. Even when the horizontal length B2 and the thickness T2 of the door 13 are identical to those of the conventional electric oven, the substantial entire extended length (L21+L22+L23) of the choking portion is increased. In addition, even when the horizontal length B2 and the thickness T2 of the door 13 are decreased as compared with those of the conventional electric oven, the substantial entire extended length (L21+L22+L23) of the choking portion is increased by the vertical length D2 of the step 26. Therefore, the substantial entire extended length (L21+L22+L23) of the choking portion is to be increased by the step 26 in a state where the thickness of the door 13 is not varied.

That is, since a choking chamber 35 is extended by the step 26 and the choking portion 29, the substantial entire extended length (L21+L22+L23) of the choking portion is increased by a dual-bending effect obtained by the step 26.

Furthermore, since the step 26 functions as a reinforcing part for the doorframe 25, even when other impact is applied to the doorframe 25, the door 13 is maintained in a stable state, not being deformed. Furthermore, since the thickness T2 of the door 13 can be decreased by the step 26, the weight of the oven can be further reduced.

In order to further improve the microwave attenuation effect with respect to a specific frequency, it is preferable that the vertical length A2 of the choking portion is 1.5–2 times as long as the horizontal length B2 of the choking portion.

When the step 26 is formed in a multiple-step, the microwave attenuation effect with respect to a specific frequency can be further improved. That is, the inner surface of the doorframe 25 may be bent in a 2-step, a 3-step or more to further increase the substantial entire extended length (L21+L22+L23) of the choking portion. Therefore, as a frequency bandwidth having a microwave attenuation effect with respect to the specific frequency is enlarged, the amount of the microwave that is externally leaked can be remarkably reduced.

Figure 5:
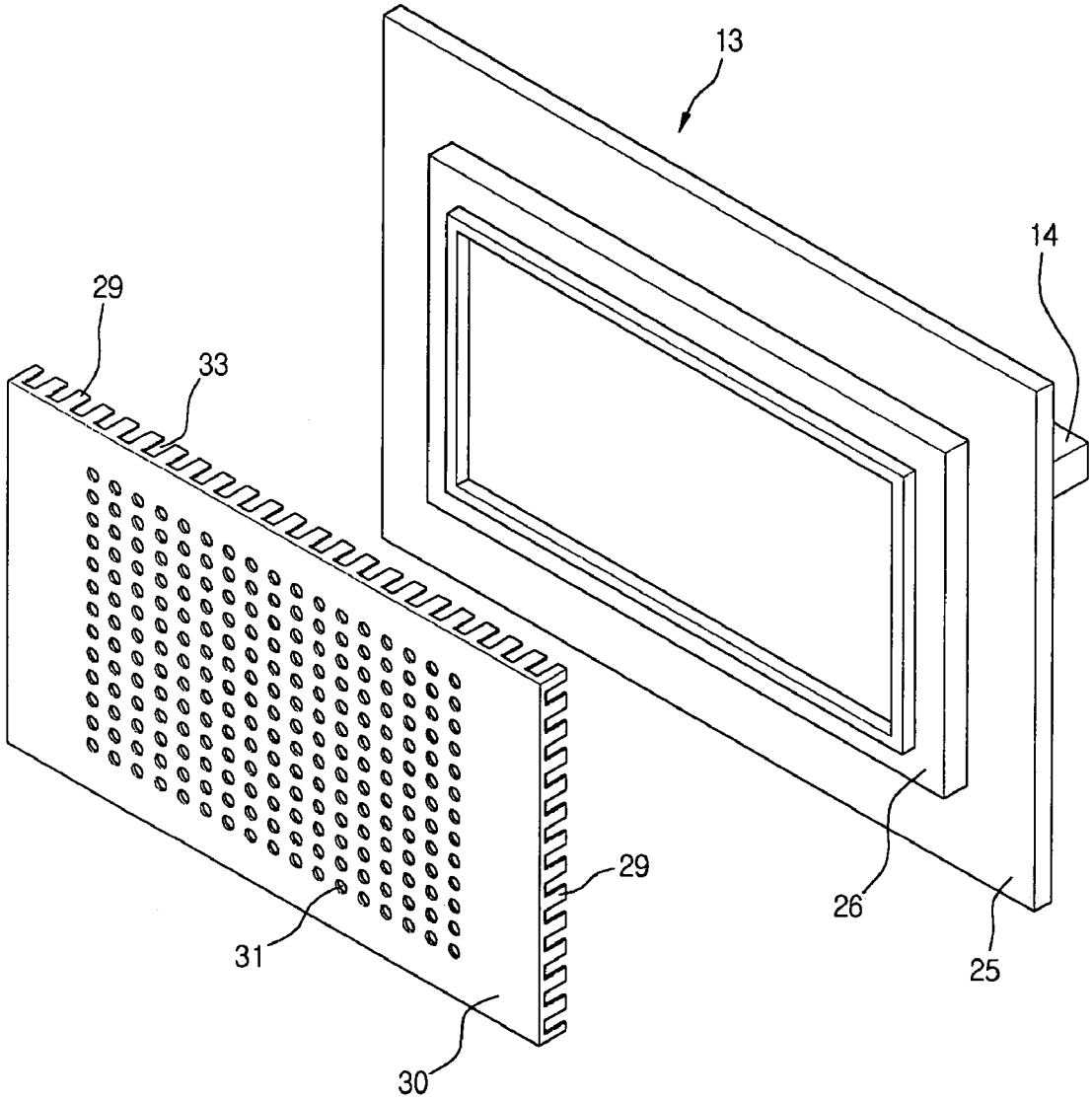
FIG. 5 is a perspective view illustrating a coupling state of a choking portion and a door according to a preferred embodiment of the present invention.

FIG. 5 shows a coupling state of a choking portion and a door according to a preferred embodiment of the present invention.

As shown in the drawing, the horizontal portion of the choking portion 29 is defined by a periphery of the screen 30 and the vertical portion of choking portion 29 is defined by a flange integrally formed around the screen 30. The choking portion 29 is provided with a plurality of notches 33 spaced away from each other at an identical interval.

The screen 30 is disposed contacting an inner surface near the inner circumference of the doorframe 25. The choking portion 29 is disposed at a portion spaced away from the step 26 at a predetermined interval.

In the above embodiment, the screen 30 and the choking portion 29 are integrally formed in a signal body, but the present invention is not limited to this. That is, they can be separately prepared. In this case, the choking portion 29 is fixed on the inner surface of the door 13 as an independent part, and the screen 30 is also fixed on a portion of the inner surface as an independent part.

Figure 6:
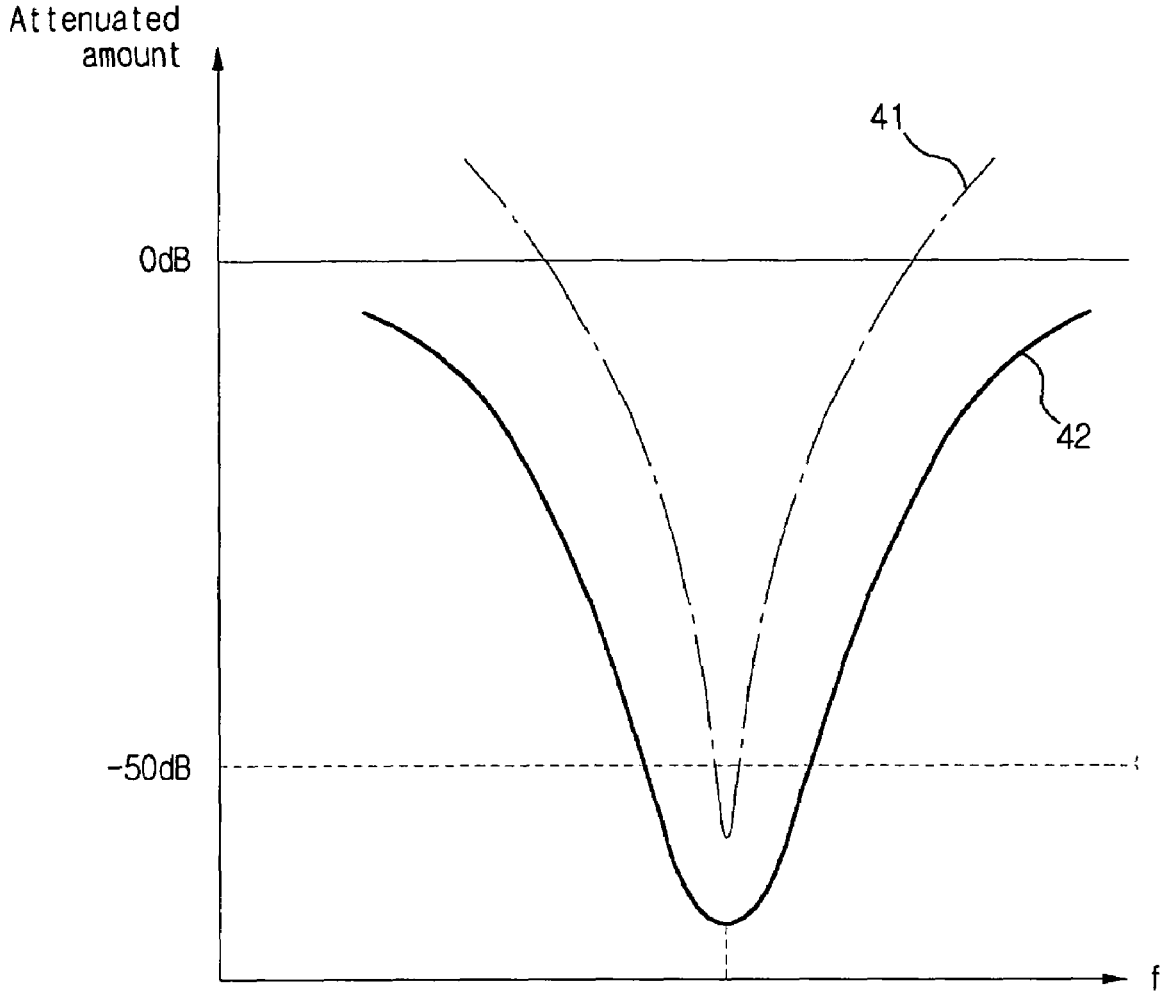
FIG. 6 is a graph illustrating an effect of the present invention.

FIG. 6 shows a graph of an operational effect of the present invention.

In the graph, a vertical axis represents attenuated amount, and a horizontal axis indicates frequency. The reference numeral 41 shows a curved line for a conventional oven while the reference numeral 42 shows a curved line for the inventive oven of the present invention. As represented by the curved lines 41 and 42, it can be noted that the bandwidth and attenuated amount of the conventional oven are less than those of the inventive oven of the present invention.

As described above, the present invention has an advantage in that the microwave shielding effect can be further improved while the thickness of the door is reduced.

Furthermore, since the choking portion is installed around the inner surface of the doorframe in a state where the doorframe is bent, the substantial entire extended length of the choking portion is increased to enlarge the bandwidth, thereby improving the microwave attenuation effect.

In addition, the weight of the door can be reduced, making it easy for a user to open and close the door.

Furthermore, as the doorframe is bent, the rigidity of the doorframe is enhanced against the outer impact.

Even when the thickness of the door is reduced, the microwave attenuation effect can be identical or improved as compared with the conventional oven.

Furthermore, as the thickness of the door is reduced, the overall size of the oven can be reduced to be compact while increasing the space of the cavity.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An electric oven, comprising:

an outer case;

a cavity formed in the outer case to receive food;

an operating part formed on the outer case to operate the oven;

a heater configured to transmit heat into the cavity;

a magnetron that oscillates a microwave to heat food loaded in the cavity;

a door formed on a front of the outer case to selectively open the cavity;

a choking portion disposed on the door to shield the microwave, the choking portion comprising a perpendicular portion disposed perpendicular to the inner surface of the door, and a parallel portion disposed parallel to the inner surface of the door;

a plurality of steps formed on a portion of the inner surface of the door, the plurality of steps together with the choking portion defining a choking chamber, the plurality of steps contacting the parallel portion, wherein the perpendicular portion of the choking portion extends outside a periphery of the plurality of steps such that a portion of the choking chamber defined by the perpendicular and parallel portions of the choking portion and the plurality of steps comprises a bent shape.

2. The electric oven according to claim 1, wherein a length of the choking chamber is increased by the steps.

3. The electric oven according to claim 1, wherein a length of the parallel portion is less than that of the perpendicular portion.

4. The electric oven according to claim 3, wherein the length of the perpendicular portion is 1.5–2 times as long as the length of the parallel portion.

5. The electric oven according to claim 1, wherein the choking portion is integrated with a screen.

6. The electric oven according to claim 1, wherein the heater comprises at least one of a lower heater disposed under the cavity, an upper heater formed on a top of the cavity, and a convection heater that discharges conventinn current heat.

7. The electric oven according to claim 1, wherein the plurality of steps are spaced away from the choking portion at a predetermined interval.

8. The electric oven according to claim 1, wherein the choking portion is disposed in the cavity.

9. The electric oven according to claim 1, wherein a choking chamber is defined by the door and the choking portion is bent more than twice.

10. A choking structure of an electric oven, comprising:

a cavity that receives food;

a magnetron that oscillates a microwave to heat food received in the cavity;

a door mounted on a front of the cavity and provided at an inner surface with a plurality of steps; and a choking portion fixed on the door to define a choking chamber with the plurality of steps to attenuate the microwave, the choking portion comprising a perpendicular portion disposed perpendicular to the inner surface and a parallel portion disposed parallel to the inner surface, the perpendicular portion of the choking portion extending outside a periphery of the plurality of steps such that a portion of the choking chamber defined by the perpendicular and parallel portions of the choking portion and the plurality of steps comprises a bent shape, wherein the plurality of steps prolong a substantial entire length of the choking portion in order to enhance a microwave attenuation effect.

11. The choking structure according to claim 10, wherein the choking chamber is bent more than twice.

12. The choking structure according to claim 10, wherein the parallel portion extends outward from the inner surface and the perpendicular portion is bent and extends from the parallel portion.

13. The choking structure according to claim 10, wherein a length of the perpendicular portion is greater than that of the parallel portion.

14. The choking structure according to claim 10, wherein the choking portion is integrally formed with a screen provided with a plurality of apertures.

15. The choking structure according to claim 10, wherein the door is partly disposed in the cavity.

16. A choking structure of a cooking device, comprising:

a cavity that receives food;

a door mounted npening of the cavity and provided at an inner surface with a plurality of steps; and a choking portion fixed on the door to define a choking chamber with the plurality of steps to attenuate a microwave, comprising a perpendicular portion disposed perpendicular to the inner surface and a parallel portion disposed parallel to the inner surface, wherein the perpendicular portion of the choking portion extends outside a periphery of the plurality of steps such that a portion of the choking chamber defined by the perpendicular and parallel portions of the choking portion and the plurality of steps comprises at least two connecting longitudinal sections.

17. The choking structure according to claim 16, wherein the choking chamber is bent more than twice.

18. The choking structure according to claim 16, wherein the choking chamber is bent more than one time.

* * * * *